US011791530B2

(12) United States Patent
Fonseca

(10) Patent No.: US 11,791,530 B2
(45) Date of Patent: Oct. 17, 2023

(54) WAVEGUIDE POWER DIVIDER

(71) Applicant: European Space Agency, Paris (FR)

(72) Inventor: Nelson Fonseca, Noordwijk (NL)

(73) Assignee: European Space Agency, Paris (FR)

( * ) Notice: Subject to any disclaimer, the term of this patent is extended or adjusted under 35 U.S.C. 154(b) by 231 days.

(21) Appl. No.: 17/174,160

(22) Filed: Feb. 11, 2021

(65) Prior Publication Data

US 2021/0249748 A1 Aug. 12, 2021

(30) Foreign Application Priority Data

Feb. 12, 2020 (EP) ..... 20157041

(51) Int. Cl.

| | |
|---|---|
| ***H01P 5/16*** | (2006.01) |
| ***H01Q 21/06*** | (2006.01) |
| ***H01P 1/161*** | (2006.01) |
| ***H01P 5/19*** | (2006.01) |

(52) U.S. Cl.

CPC ..... *H01P 5/16* (2013.01); *H01P 1/161* (2013.01); *H01P 5/19* (2013.01); *H01Q 21/064* (2013.01)

(58) Field of Classification Search

CPC ... H01P 5/16; H01P 1/161; H01P 5/19; H01Q 21/064

See application file for complete search history.

(56) References Cited

U.S. PATENT DOCUMENTS

| | | | |
|---|---|---|---|
| 2019/0097296 A1 | 3/2019 | Fraysse et al. | |
| 2019/0190161 A1 | 6/2019 | Hollenbeck et al. | |

FOREIGN PATENT DOCUMENTS

| | | | |
|---|---|---|---|
| EP | 3179551 A1 * | 6/2017 | ..... H01P 1/161 |
| ES | 2 555 634 A1 | 1/2016 | |
| WO | 2021/083498 | 5/2021 | |

OTHER PUBLICATIONS

European Search Report for Application No. EP 20 15 7041.3 dated Jul. 24, 2020, 10 pgs.

(Continued)

*Primary Examiner* — Andrea Lindgren Baltzell

*Assistant Examiner* — Kimberly E Glenn

(74) *Attorney, Agent, or Firm* — SEED INTELLECTUAL PROPERTY LAW GROUP LLP

(57) ABSTRACT

A waveguide power divider device comprises four two-port orthomode junctions arranged with their common waveguides extending in parallel, wherein the two ports of each orthomode junction extend in orthogonal directions, four E-plane T-junctions, each T-junction coupling two of the four orthomode junctions to each other via respective ones of their ports, a four-port turnstile junction, wherein waveguides of the four ports are bent to extend in parallel to an extension direction of a common waveguide of the turnstile junction, and four waveguide twists, each waveguide twist coupling a common waveguide of a respective one of the T-junctions to the waveguide of a respective one of the ports of the turnstile junction, with broad walls of the common waveguide of the T-junction and of the waveguide of the port of the turnstile junction being orthogonal to each other. An array antenna may include one or more such waveguide power divider devices.

13 Claims, 14 Drawing Sheets

(56) References Cited

OTHER PUBLICATIONS

Cano, J.L. et al., "Novel Broadband Circular Waveguide Four-Way Power Divider for Dual Polarization Applications", IEEE Microwave and Wireless Components Letters, vol. 26, No. 2, Feb. 2016, 3 pgs.

Ruiz-Cruz, J.A. et al., "Orthomode Transducers With Folded Double-Symmetry Junctions for Broadband and Compact Antenna Feeds", IEEE Transactions on Antennas and Propagation, vol. 66, No. 3, Mar. 2018, 9 pgs.

Communication pursuant to Article 94(3) EPC for European Application No. 20 157 041.3-1205, dated Feb. 22, 2022, 6 pages.

Tubau, S. et al., "Design of a Compact Four-Way Dual Polarization Orthomode Power Divider for Multiport Radiating Elements", 13$^{th}$ European Conference on Antennas and Propagation (EuCAP 2019), 5 pgs.

* cited by examiner

WAVEGUIDE POWER DIVIDER

BACKGROUND

Technical Field

This application relates to waveguide power dividers (waveguide power divider devices). In particular, the application relates to dual-polarization four-way power dividers.

Description of the Related Art

There are on-going developments of array antennas, either for active antennas with a combination of analog and digital beamforming techniques or passive fixed antennas with mechanical steering. While the first solution is mostly developed for space applications, both solutions can be feasible for ground segment user terminals and in particular aeronautical applications.

For array antennas, it is desirable to reduce the length of radiating elements. For example, radiating elements in current space-segment active antennas for GEO satcom applications typically have an aperture in the range of 2 to 3 wavelengths. This aperture size is constrained by the wish to reduce the number of elements for a given array aperture size while maintaining grating lobes outside of the field of view. A typical horn design with high aperture efficiency has a length of about 2 to 3 times its aperture diameter. For Ku-band applications, this results in a rather bulky radiating element. A possible way to shorten the radiating element is to divide the aperture in smaller elements and combine them using a suitable beamforming network. This requires compact power dividers (e.g., four-way power dividers), preferably operating in dual-polarization.

However, current designs for dual-polarization four-way power dividers are either rather complex or fail to allow for reducing the element spacing of array antennas below a certain threshold (e.g., one wavelength).

Thus, there is a need for improved waveguide power divider devices, especially four-way waveguide power divider devices. There is particular need for simple and more compact waveguide power divider devices, preferably suitable for dual polarization operation. There is further need for such waveguide power divider devices that are compatible with alternative manufacturing techniques, such as 3D printing (additive layer manufacturing), for example.

BRIEF SUMMARY

In view of some or all of these needs, the present disclosure proposes a waveguide power divider device having the features of claim 1. The present disclosure further proposes an array antenna including one or more such waveguide power divider devices.

An aspect of the disclosure relates to a waveguide power divider device. The waveguide power divider device may be a four-way power divider device. The waveguide power divider device may include four two-port orthomode junctions (e.g., two-probe orthomode junctions). The two-port orthomode junctions may be arranged with their common waveguides (e.g., common ports) extending in parallel. The common waveguides of the two-port orthomode junctions may be arranged in a square or rectangular shape, i.e., with centers of respective cross sections at the vertices of a square or rectangular lattice. In other words, the common waveguides may be arranged in a two-by-two array (e.g., square or rectangular two-by-two array). The two ports (e.g., probes) of each orthomode junction may extend in orthogonal directions. Moreover, the ports of the orthomode junctions may extend in directions orthogonal to the extension direction of the common waveguides of the orthomode junctions. The waveguide power divider device may further include four E-plane T-junctions. Each T-junction may couple (e.g., link) two of the four orthomode junctions to each other via respective ones of their ports. The waveguide power divider device may further include a four-port turnstile junction. Waveguides of the four ports of the turnstile junction may be bent to extend in parallel to an extension direction of the common waveguide of the turnstile junction. The waveguide power divider device may yet further include four waveguide twists. The waveguide twists may be referred to as twist portions, or simply, twists. Each waveguide twist may couple (e.g., link) a common waveguide of a respective one of the T-junctions to the waveguide of a respective one of the ports of the turnstile junction, with the broad walls of the common waveguide of the T-junction and of the waveguide of the port of the turnstile junction being orthogonal to each other.

Configured as described above, the proposed waveguide power divider device is a four-way power divider that is suitable for dual-polarization operation. The coupling of the orthomode transducers to each other by the E-plane T-junctions followed by the waveguide twists allows for a very small element spacing, i.e., very small spacing between the common waveguides of the orthomode transducers. Typically, element spacings well below one wavelength can be achieved. Moreover, the small element spacing can be achieved with a limited waveguide routing between the various constituting components, from the orthomode junctions to the turnstile junction, thus leading to a comparatively small height of the waveguide power divider device.

As an additional benefit, the proposed waveguide power divider device features an adequate amplitude and phase distribution, in the sense that electromagnetic field complex vectors (e.g., directions and phases) at the common waveguides of the four orthomode junctions are aligned and in-phase with each other for a given electromagnetic field configuration at the common waveguide of the turnstile junction. This makes the proposed waveguide power divider device particularly suitable for the design of active or passive waveguide arrays with a small element spacing. Therein, these arrays are scalable by using combinations of a plurality of the proposed waveguide power divider devices.

Advantageously, array antennas involving one or more of the proposed waveguide power divider device can be designed without horns forming the aperture, at equivalent aperture efficiency to conventional array antennas with horns. In this case, the array elements are open-ended waveguides, directly coupled (e.g., connected) to one or more of the waveguide power divider devices. Finally, the proposed waveguide power device is suitable for manufacturing by 3D printing techniques (e.g., additive layer manufacturing) and thus can be manufactured in a simple and cost-effective manner.

In some embodiments, the waveguide twists may have identical shape. They may be rotated from one to another by 90 degrees around an axis extending in parallel to the common waveguide of the turnstile junction. Further, the waveguide twists may be arranged to interlock (e.g., mesh) with each other when seen from a direction along the common waveguide of the turnstile junction. Accordingly, the waveguide twists may be separated from each other by thin walls only. Thereby, the twist layer (or twist plane)

comprising the four waveguide twists can be implemented in a very compact manner and an amount of material needed for implementing the twist layer can be reduced, resulting in a low mass figure.

In some embodiments, a shape of each waveguide twist when seen from a direction along the common waveguide of the turnstile junction may include two rectangles (rectangular shapes) that have parallel edges and that overlap with each other at a pair of their corners. That is, the waveguide twists may have a "bow-tie" shape. This shape allows for a very compact arrangement of the four waveguide twists in the twist layer.

In some embodiments, the waveguide twists may be offset twists. That is, the cross sections of the common waveguide of the T-junction and the waveguide of the port of the turnstile junction may intersect, when seen from the direction along the common waveguide of the turnstile junction, in a point or area that is offset from a center of at least one of the cross sections. Accordingly, the aforementioned two rectangles may have different dimensions (sizes). By appropriately offsetting the waveguides of the ports of the turnstile junction relative to the common waveguides of the T-junctions away from a center axis of the waveguide power divider device, the distance between the orthomode junctions may be reduced independently of the size of the turnstile junction, thus enabling element spacing values well below one wavelength at the lowest operating frequency.

In some embodiments, for each orthomode junction, the two ports may each face one of the ports of a respective other one among the orthomode junctions. Then, each T-junction may couple (e.g., link) facing ports of respective orthomode junctions to each other. Notably, no matching sections are necessary in the proposed configuration for implementing these couplings.

In some embodiments, the turnstile junction may include one or more steps in the bends of each of its four ports. These steps may be said to be arranged at respective linking portions between the common waveguide and the ports of the four-port turnstile junction. They may extend, for each port, in a direction orthogonal to the extension directions of the common waveguide and the direction in which the respective port exits the turnstile junction. These steps may improve matching of the bend and thereby enhance performance of the waveguide power divider device.

In some embodiments, the waveguide power divider device may include matching sections in the common waveguides of the orthomode junctions. Alternatively or additionally, the waveguide power divider device may include a matching section in the common waveguide of the turnstile junction. By providing these matching sections, overall performance of the waveguide power divider device can be further improved.

In some embodiments, the waveguide power divider device may be a dual-polarization power divider device. That is, the waveguide power divider device may be suitable for dual-polarization operation. In combination with a suitable orthomode transducer (OMT), the waveguide power divider device may operate in dual-linear polarization or dual-circular polarization.

In some embodiments, the waveguide power divider device may be suitable for manufacturing by additive layer manufacturing. This property, which results from the specific arrangement of the constituting components of the proposed waveguide power divider device, enables manufacturing of the waveguide power divider device as a single (e.g., monolithic) piece in a particularly simple and cost-efficient manner, reducing mostly assembly design constraints (e.g., space required for screws), impact on performance (e.g., signal leakage at interfaces between layers in conventional multi-layer CNC milling manufacturing and assembly), and integration effort.

Another aspect of the disclosure relates to an array antenna including one or more waveguide power divider devices according to the above aspect or any of its embodiments.

Such an array antenna will feature small element spacing and will be readily scalable by including and appropriately combining additional waveguide power divider devices. Moreover, due to the performance characteristics of the waveguide power divider device, the array antenna can be implemented without horns at adequate aperture efficiency.

In some embodiments, the array antenna may include a plurality of array elements. The array elements may be open-ended waveguides corresponding to the common waveguides of the two-port orthomode junctions of one or more of the one or more waveguide power divider devices. The array elements may form the aperture of the antenna. Since it uses open-ended waveguides, the array antenna may not comprise any horns. Omission of the horns allows to realize a very compact array spacing between antenna elements.

In some embodiments, the array antenna may include a plurality of waveguide power divider devices. At least two of the waveguide power divider devices may be arranged such that the common waveguides of the orthomode junctions of the at least two waveguide power divider devices form an array. The common waveguides of the orthomode junctions may be arranged in a regular (e.g., square or rectangular) lattice.

In some embodiments, the array antenna may include a plurality of waveguide power divider devices. Therein, a first waveguide power divider device among the plurality of waveguide power divider devices may be coupled to a second waveguide power divider device among the plurality of waveguide power divider devices such that the common waveguide of an orthomode junction of the first waveguide power divider device is coupled to the common waveguide of the turnstile junction of the second waveguide power divider device. For example, two or more of the waveguide power divider devices may be arranged to form the aforementioned array, and at least one further waveguide power divider device may be coupled to the common waveguide of the turnstile junction of one of the waveguide power divider devices in the array through the common waveguide of one of its orthomode junctions.

In the context of the present disclosure, the term to "couple" two waveguides shall mean to link or otherwise connect these waveguides such that an electromagnetic field (or electromagnetic signal in general) may propagate from one waveguide to the other waveguide.

It will be appreciated that apparatus features and method steps may be interchanged in many ways. In particular, the details of the disclosed apparatus (e.g., waveguide power divider device) can be realized by the corresponding method of manufacturing the apparatus, and vice versa, as the skilled person will appreciate. Moreover, any of the above statements made with respect to the apparatus are understood to likewise apply to the corresponding method, and vice versa.

BRIEF DESCRIPTION OF THE SEVERAL VIEWS OF THE DRAWINGS

Example embodiments of the disclosure are explained below with reference to the accompanying drawings, wherein.

DETAILED DESCRIPTION

Figure 1B:
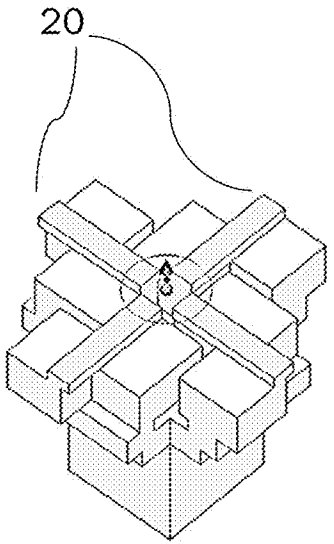
FIG. 1A through FIG. 1D schematically illustrate different clipping planes of an example of a waveguide power divider device according to embodiments of the disclosure.

Several solutions for reducing size (e.g., height/length or lateral spacing between output ports) and/or complexity of four-port power divider devices (power dividers) are feasible.

One feasible solution makes use of open-ended square waveguides in a sub-wavelength lattice. Septum polarizers are used to separate two orthogonal polarizations. The beamforming network is a combination of E-plane and H-plane power dividers, where polarizations are treated separately. This solution allows implementing an array and its beamforming network that have a combined length of about 1.5 times its aperture size. This represents some improvement over single horn designs. However, the beamforming network design is complex and is not easily scalable.

An alternative solution to reduce the length of the array is to use a turnstile power divider to separate (or combine) the two orthogonal polarizations in place of a septum polarizer. While this solution is attractive to reduce the length of the structure, the combination of a turnstile junction and H-plane power dividers leads to an element spacing of about 2 wavelengths. In addition, the phase distribution is not directly compatible with an array design in that ports out of phase will result in a null on-axis in the radiation pattern.

Another solution uses the same two-probe orthomode transducer arrangement, but with two-probe junctions replaced by four-probe junctions and E-plane junctions rather than H-plane junctions to reduce the element spacing. In this case, the spacing can be reduced to one wavelength, but the overall design is extremely complex as the two-probe junctions are replaced by four-probe junctions, thus requiring multi-level power combination.

A simpler design uses two-probe junctions in place of the four-probe junctions. However, the E-plane T-junctions and bends in between pairs of two-probe junctions constrain the achievable minimum spacing. This solution still remains complex and does not allow element spacing below one wavelength.

Neither of the aforementioned designs for dual-polarization four-way power dividers is both simple and allows for reducing the element spacing of array antennas below one wavelength. Embodiments of the present disclosure address some or all of these shortcomings.

In the following, example embodiments of the disclosure will be described with reference to the appended figures. Identical elements in the figures may be indicated by identical reference numbers, and repeated description thereof may be omitted for reasons of conciseness.

Broadly speaking, the present disclosure relates to a waveguide power divider device suitable for dual-polarization operation (i.e., to a dual-polarization power divider device). As such, it provides a compact dual-polarization four-way power divider for millimeter and sub-millimeter wave electromagnetic systems and in particular beam forming networks for array antennas. Thereby, the proposed waveguide power divider device enables the design of very compact dual-polarization beam forming networks for passive arrays in waveguide technology. Notwithstanding, the proposed waveguide power divider device may also be used in other millimeter wave and sub-millimeter wave components, such as distributed power amplifiers, for example.

Figure 1A:
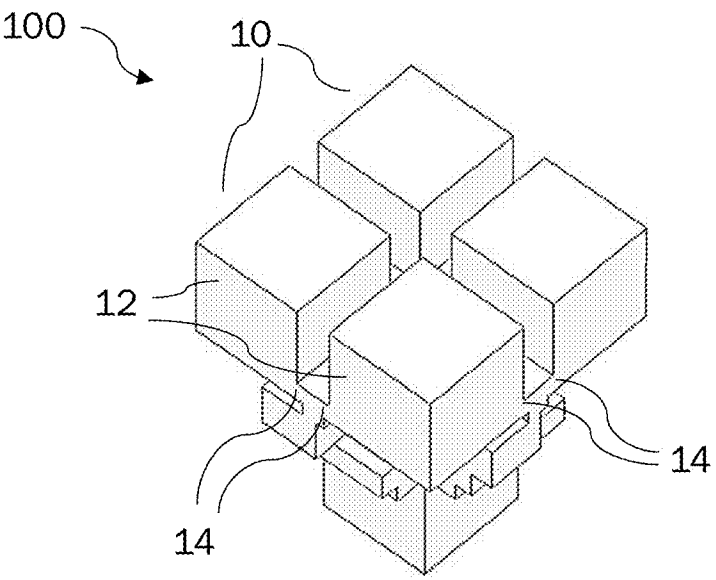
Figure 1D:
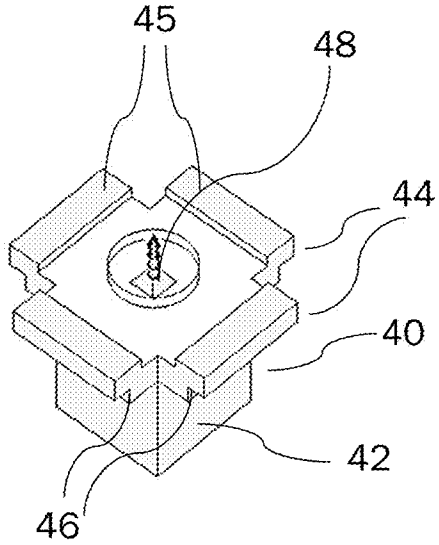
Figure 1C:
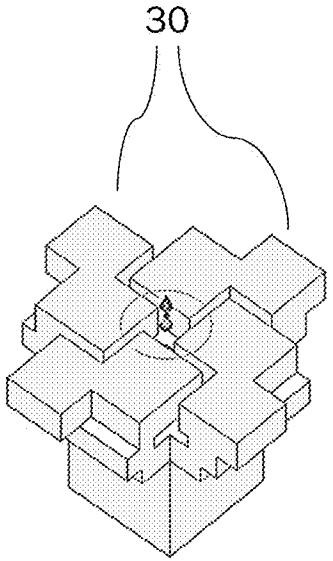

An example of a waveguide power divider device 100 (or rather, its waveguide portions) according to embodiments of the disclosure is schematically illustrated in FIG. 1A through FIG. 1D. Therein, FIG. 1A shows a full view of the waveguide power divider device 100. FIG. 1B through FIG. 1D show various cross-sectional views of the waveguide power divider device with the (virtual) clipping plane moving down along the longitudinal axis of the device, equivalent to the removal of increasing numbers of (virtual) layers. As commonly done in the field, the waveguides are represented here by illustrating the vacuum (or propagation medium) constrained within conductive material rather than the actual material constituting the component, as this facilitates the visualization of the path followed by the electromagnetic field.

Figure 2:
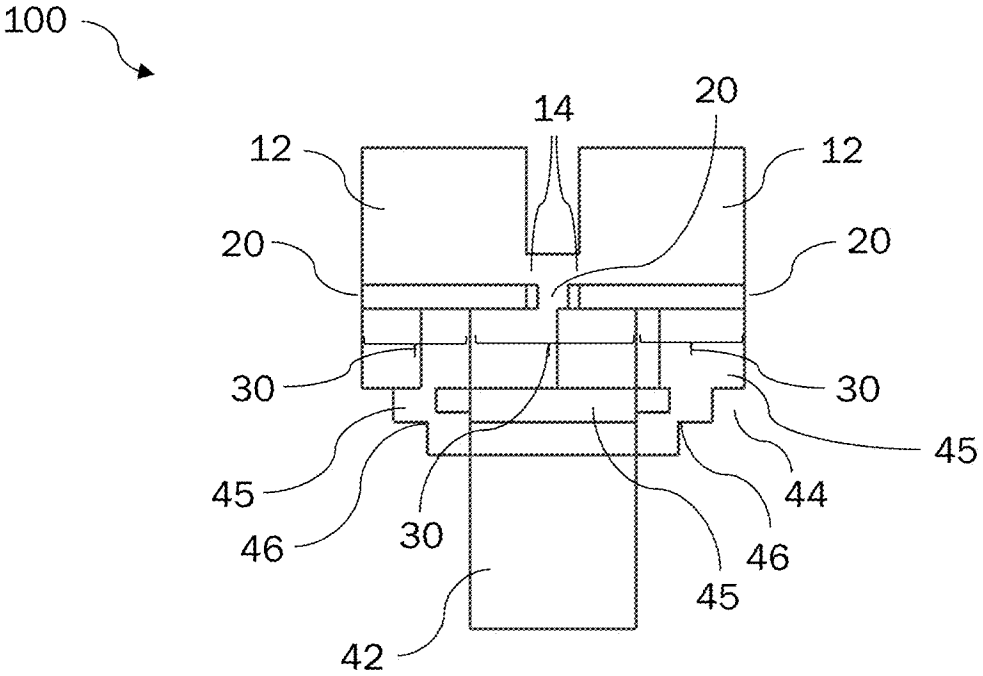
FIG. 2 is a side view of the waveguide power divider device shown in FIG. 1A through FIG. 1D, FIG. 3A and FIG. 3B schematically illustrate a top view and a bottom view, respectively, of an example of a mechanical multi-layer structure implementing metallic boundaries of the waveguide power divider device shown in FIG. 1A through FIG. 1D, FIG. 3C and FIG. 3D schematically illustrate a top view and a bottom view, respectively, of another example of a mechanical single-piece structure implementing metallic boundaries of the waveguide power divider device shown in FIG. 1A through FIG. 1D, FIG. 4A through FIG. 4D illustrate electric field vectors in the different clipping planes of the waveguide power divider device shown in FIG. 1A through FIG. 1D for a first polarization mode.

FIG. 2 is a side view of the waveguide power divider device 100. The waveguide power divider device 100 comprises four two-probe orthomode junctions (e.g., orthomode transducers) 10, four E-plane T-junctions 20, four twists (e.g., waveguide twists, or twist portions) 30, and one turnstile junction (e.g., four-port turnstile junction) 40. The orthomode junctions 10, E-plane T-junctions 20, twists 30, and turnstile junction 40 can be imagined as being arranged in respective (virtual) layers of the waveguide power divider device 100, between a topmost layer and a bottommost layer. FIG. 1A shows the complete waveguide power divider device including the four orthomode junctions 10, and thereby illustrates the arrangement of the orthomode junctions 10 and the connection between them. FIG. 1B shows a first clipping-plane (equivalent to the removal of a topmost virtual layer), providing visibility on the common waveguides of the four E-plane T-junctions 20, and thereby illustrates the arrangement of the common waveguides of the E-plane T-junctions 20. The next lower layer (third layer), providing visibility on the four twists 30 that enable rotating the four common waveguides of the E-plane T-junctions, is illustrated in FIG. 1C. Finally, FIG. 1D shows the lowest clipping plane (equivalent to the removal of a third virtual layer), providing visibility on the ports of the turnstile junction 40 after the bends, and thereby illustrates the connection of the bent waveguides through the turnstile junction 40.

The four two-port orthomode junctions 10 are arranged with their common waveguides (e.g., common waveguide ports, or common ports) 12 extending in parallel. For example, the common waveguides 12 of the two-port orthomode junctions 10 may be arranged in a square or rectangular shape, i.e., with centers of respective cross sections at the vertices of a square or rectangular lattice. In other words, the common waveguides may be arranged in a two-by-two array (e.g., square or rectangular two-by-two array).

The two ports (e.g., probes) 14 of each orthomode junction 10 extend in orthogonal directions. In addition, the ports 14 of the orthomode junctions 10 may extend in directions orthogonal to the extension direction of the common waveguides 12 of the orthomode junctions 10. Further, each port (e.g., probe) 14 of an orthomode junction 10 is connected to a port 14 of another orthomode junction 10 through one of the E-plane T-junctions 20. That is, each E-plane T-junction 20 couples two of the four orthomode junctions 10 to each other via respective ones of their ports 14. For instance, for each orthomode junction 10, the two ports 14 may each face one of the ports 14 of a respective other one among the orthomode junctions 10, and each T-junction 20 may couple facing ports 14 of respective orthomode junctions 10 to each other. The common waveguides (e.g., common waveguide ports, or common ports) of the E-plane T-junctions 20 are orthogonal to the plane containing the four orthomode junctions 10.

Each twist 30 couples a common waveguide of a respective one of the T-junctions 20 to the waveguide 45 of a respective one of the ports (e.g., probes) 44 of the turnstile junction 40. Therein, the broad walls of the common waveguide of the T-junction 20 and of the waveguide 45 of the port 44 of the turnstile junction 40 are orthogonal to each other. In other words, each twist 30 is connected to the common waveguide of a T-junction 20, rotating each common waveguide by 90 degrees. The twists 30 may be offset twists, for example. The rotated common waveguides, which correspond to waveguides 45 of the ports 44 of the turnstile junction 40, are bent and coupled (e.g., linked, connected) to the turnstile junction 40. Put differently, the waveguides 45 of the four ports 44 are bent to extend in parallel to an extension direction of the common waveguide 42 of the turnstile junction 40. The common waveguide 42 of the turnstile junction 40 may extend in parallel to the common waveguides 12 of the orthomode junctions 10.

Figure 3A:
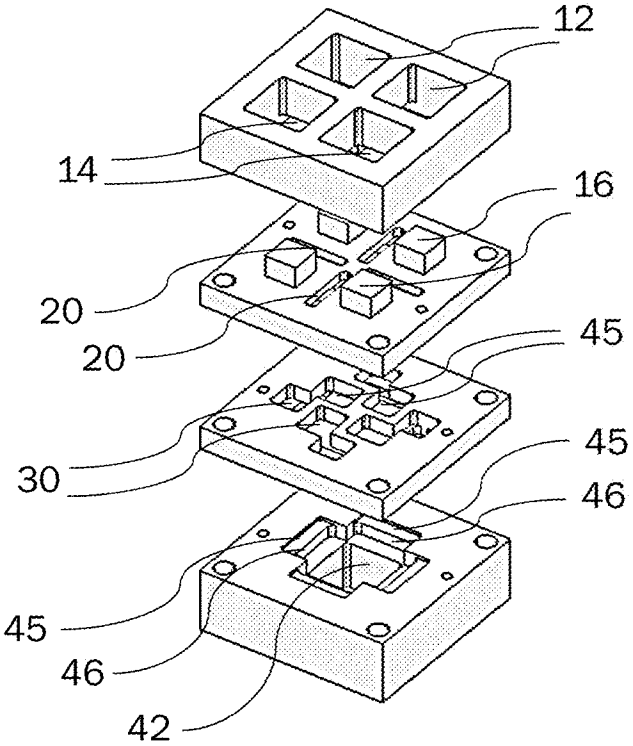
Figure 3B:
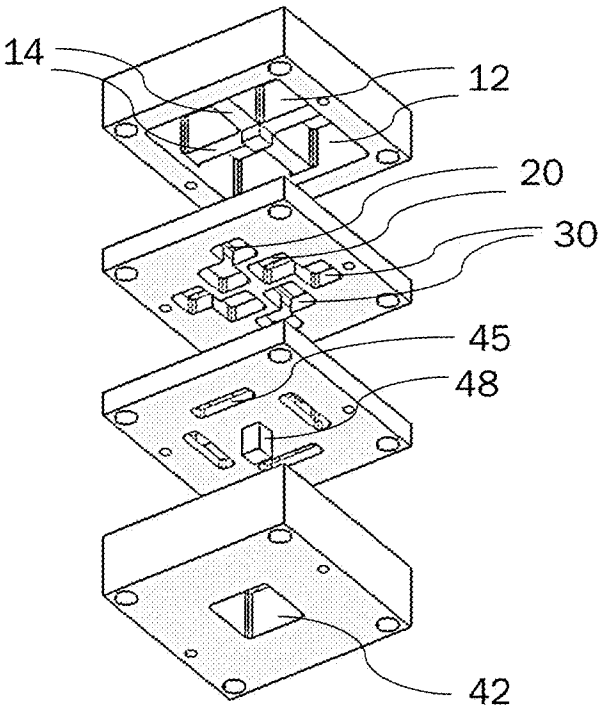

While FIG. 1A through FIG. 1D and FIG. 2 show the waveguide portions (i.e., hollow portions) of the waveguide power divider device 100, an example of a mechanical structure for implementing metal walls (boundaries) for these waveguide portions is illustrated in FIG. 3A and FIG. 3B. Therein, FIG. 3A is a slant top view of the mechanical structure, which is shown as comprising a number of (actual) mechanical layers. FIG. 3B is a slant bottom view of the mechanical structure. This mechanical structure is compatible with conventional CNC milling manufacturing, for example. The structure may be assembled using screws passing through the circular holes at the corners of each layer, for example. Smaller circular holes are also visible, which are for alignment purposes. As can be clearly seen from these figures, the common waveguides of the E-plane T-junctions 20 are coupled, via the twists 30, to waveguides 45 of the ports 44 of the turnstile junction 40. Each common waveguide of an E-plane T-junction 20 is rotated by 90 degrees with respect to the waveguide 45 of the port 44 of the turnstile junction 40 to which it is coupled.

As can be seen for example from FIG. 3A and FIG. 3B, the waveguide power divider device 100 is also suitable for manufacturing by 3D production techniques. This includes additive layer manufacturing, such as selective laser melting (SLM), for example.

Figure 3D:
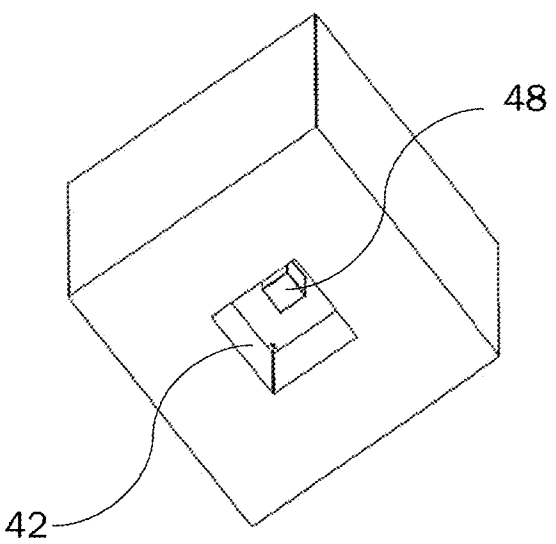
Figure 3C:
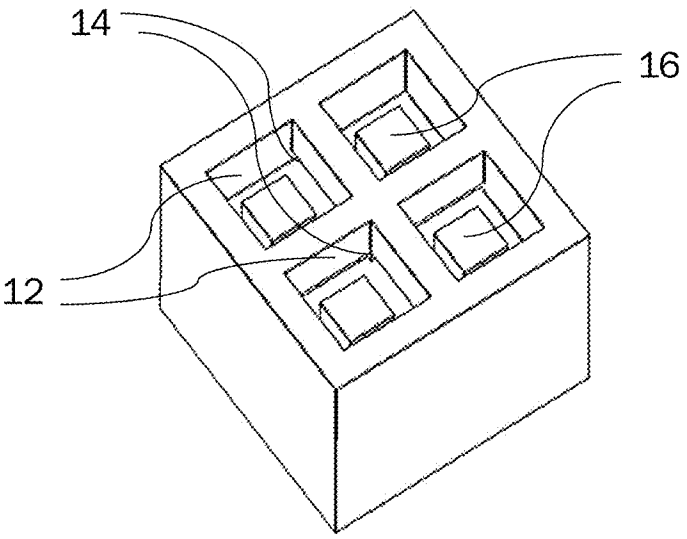

Accordingly, FIG. 3C and FIG. 3D illustrate another example of a mechanical single-piece structure for implementing metal walls (boundaries) for the waveguide portions of the waveguide power divider device 100. Therein, FIG. 3C is a slant top view of the mechanical structure and FIG. 3B is a slant bottom view of the mechanical structure. This mechanical structure is a monolithic (e.g., single-piece) structure and is compatible with 3D production techniques. The fact that the waveguide power divider device can be implemented in a mechanical structure compatible with 3D production techniques is an indicator for the low complexity of design of the waveguide power divider device.

While FIG. 3A to FIG. 3D may show mechanical structures compatible with different manufacturing methods, it is to be noted that any statements on properties of the waveguide power divider device implemented by these structures are not limited to a specific manufacturing method. In particular, also the mechanical structure of FIG. 3C and FIG. 3D could be seen as comprising a number of virtual layers, in analogy to FIG. 3A and FIG. 3B.

Summarizing the above, the starting point of the present disclosure is a combination of four two-probe orthomode junctions 10. An important design feature relates to the way those four orthomode junctions are connected. E-plane junctions 20 are used between facing probes (ports) 14 of adjacent two-probe orthomode junctions 10. Accordingly, an important design measure for achieving an extremely compact array spacing (i.e., small lateral spacing between the common waveguides 12 of the orthomode junctions 10) lies in the T-junctions 20 which require no bending. Moreover, twists 30 are used to change the direction of the common ports of the T junctions 20, enabling their combination with a turnstile junction 40 in a compact way.

Notably, the proposed design has the advantage of providing the right phase conditions for using this component in a 2×2 array antenna or larger array antennas. This property is schematically shown in FIG. 4A through FIG. 4D, which illustrate electric field vectors in the different clipping planes of the waveguide power divider device 100 for a first polarization mode, and in FIG. 5A through FIG. 5D, which illustrate electric field vectors in the different clipping planes of the waveguide power divider device 100 for a second polarization mode.

Figure 4B:
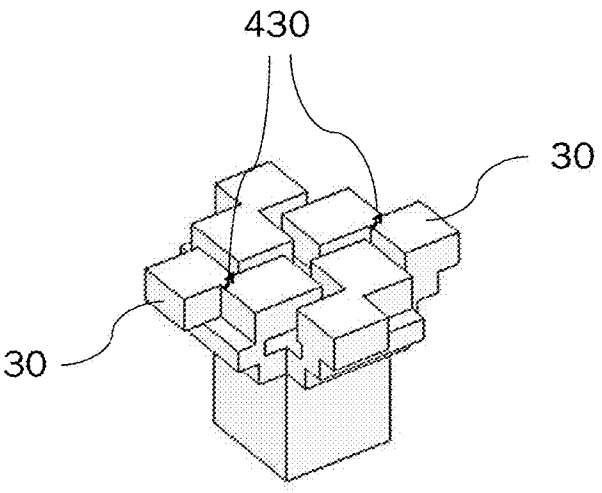
Figure 4A:
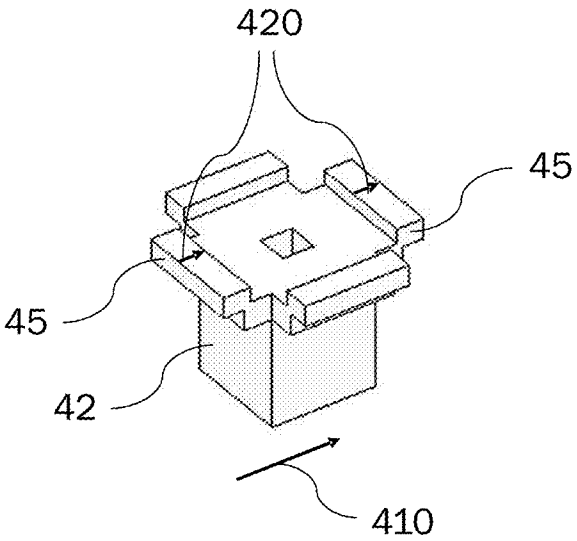
Figure 4D:
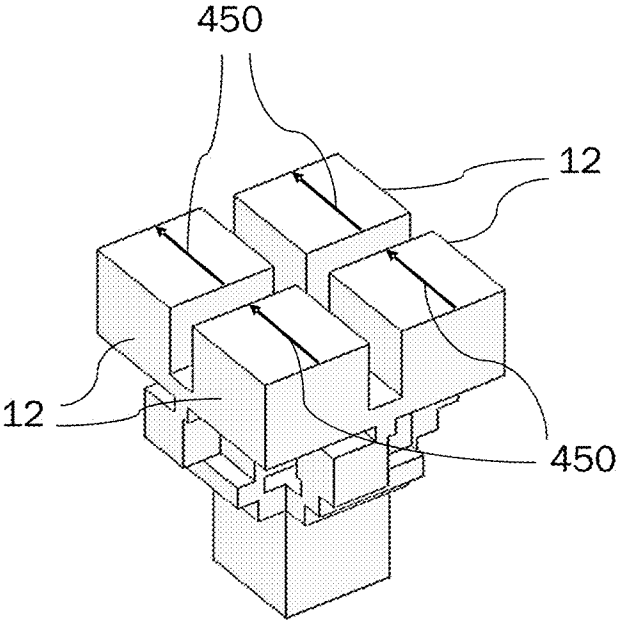
Figure 4C:
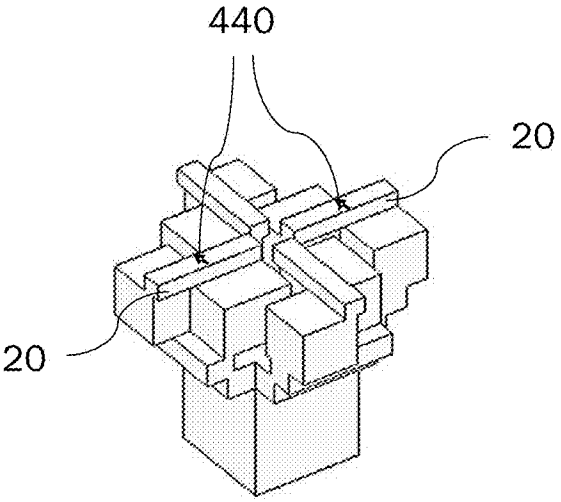

In FIG. 4A, arrow 410 indicates the direction of the $\vec{E}$-field vector in the common waveguide 42 of the turnstile junction 40 for the first polarization mode. Arrows 420 indicate the directions of the $\vec{E}$-field vector in the waveguides 45 of the ports 44 of the turnstile junction 40 for the first polarization mode. In FIG. 4B, arrows 430 indicate the directions of the $\vec{E}$-field vector in the twists 30 for the first polarization mode. Arrows 440 in FIG. 4C indicate the directions of the $\vec{E}$-field vector in the E-plane T-junctions 20 for the first polarization mode. Finally, arrows 450 in FIG. 4D indicate the directions of the $\vec{E}$-field vector in the common waveguides 12 of the orthomode junctions 10 for the first polarization mode.

Figure 5B:
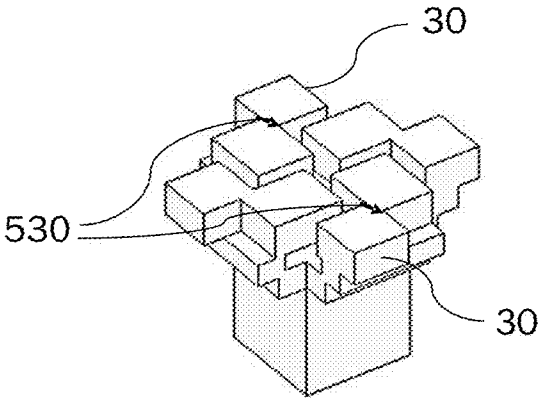
FIG. 5A through FIG. 5D illustrate electric field vectors in the different clipping planes of the waveguide power divider device shown in FIG. 1A through FIG. 1D for a second polarization mode, FIG. 6 schematically illustrates an example of an array antenna according to embodiments of the disclosure.
Figure 5A:
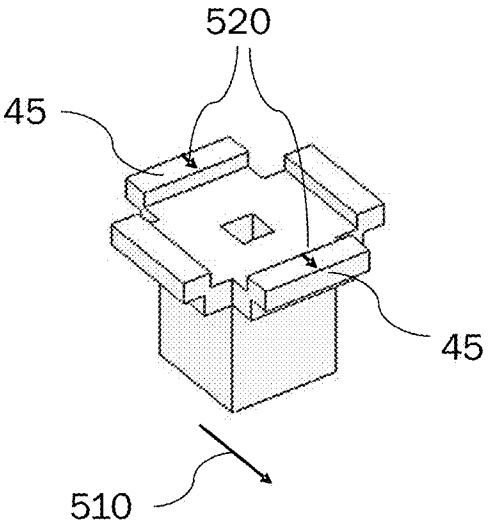
Figure 5D:
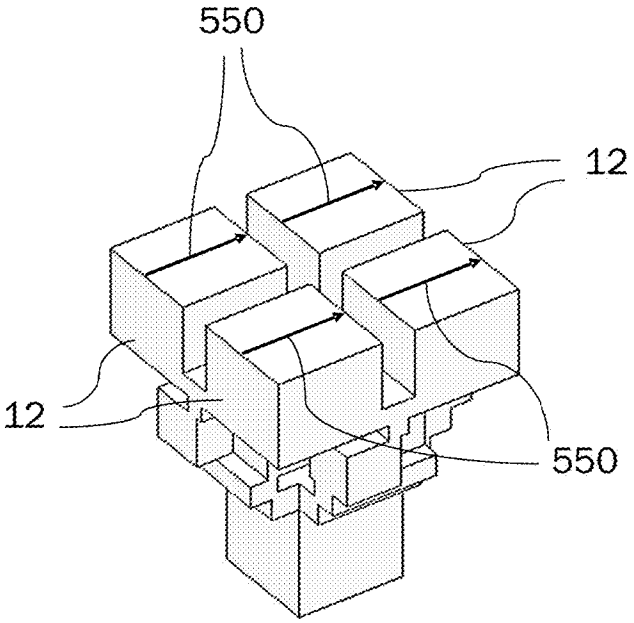
Figure 5C:
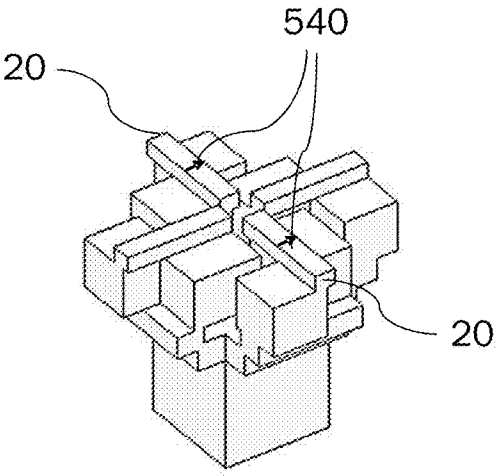

Similarly, in FIG. 5A, arrow 510 indicates the direction of the $\vec{E}$-field vector in the common waveguide 42 of the turnstile junction 40 for the second polarization mode, which is orthogonal to the first polarization mode. Arrows 520 indicate the directions of the $\vec{E}$-field vector in the waveguides 45 of the ports 44 of the turnstile junction 40 for the second polarization mode. In FIG. 5B, arrows 530 indicate the directions of the $\vec{E}$-field vector in the twists 30 for the second polarization mode. Arrows 540 in FIG. 5C indicate the directions of the $\vec{E}$-field vector in the E-plane T-junctions 20 for the second polarization mode. Finally, arrows 550 in FIG. 5D indicate the directions of the $\vec{E}$-field vector in the common waveguides 12 of the orthomode junctions 10 for the second polarization mode.

As can be seen, the directions of the $\vec{E}$-field vector in the common waveguides 12 of the orthomode junctions 10 are aligned with each other for both polarization modes, both in direction and in phase. The two orthogonal polarization modes may be two orthogonal linear polarization modes or two orthogonal circular polarization modes, depending on the structure (e.g., orthomode transducer) used to couple (e.g., connect) to the waveguide power divider device 100.

Details of the twists 30 of the waveguide power divider device 100 will be described next. As can be seen for example from FIG. 1C, the waveguide twists 30 may have identical shape and may be rotated from one to another by 90 degrees around an axis extending in parallel to the common waveguide 42 of the turnstile junction 40. Having such shape, the waveguide twists 30 are preferably arranged to interlock (or mesh) with each other when seen from a direction along the common waveguide 42 of the turnstile junction 40. Then, thin metal walls may be sufficient for separating the waveguide twists 30 from each other, which helps to reduce an amount of material needed for manufacturing the waveguide power divider device.

A specific example for the shape of the waveguide twists 30 is a "bow-tie" shape. Accordingly, the shape of each waveguide twist 30 when seen from a direction along the common waveguide 42 of the turnstile junction 40 may comprise two rectangles (rectangular shapes) that have parallel edges and that overlap with each other at a pair of their corners.

Providing twists 30 that enable to offset the ports help to provide sufficient space for the turnstile junction and thus may contribute to a further size reduction of the waveguide power divider device. Accordingly, in some embodiments the twists 30 may be offset twists. In the present context, characterizing a twist as an offset twist means that the cross sections of the common waveguide of the T-junction 20 and the waveguide 45 of the port 44 of the turnstile junction 40 may intersect, when seen from the direction along the common waveguide 42 of the turnstile junction 40, in a point or area that is offset from a center of at least one of the cross sections. In such case, the aforementioned two rectangles forming the shape of the cross section of the twists may have different dimensions (sizes).

The waveguide power divider device described up to now can achieve good efficiency and has compact size. Further improvement of its performance can be achieved by providing matching sections. For example, such matching sections may be arranged in one, any, or all of the common waveguide 42 of the turnstile junction 40, in the ports 44 of the turnstile junction 40, and/or in the common waveguides 12 of the orthomode junctions 10.

For instance, the turnstile junction 40 may comprise one or more steps 46 in the bends of each of its four ports 44, see for example FIG. 1D and FIG. 3A. These steps 46 may be said to be arranged at respective linking portions between the common waveguide 42 and the ports 44 of the four-port turnstile junction 40. They may extend, for each port 44, in a direction orthogonal to the extension directions of the common waveguide 42 and the direction in which the respective port 44 exits the turnstile junction 40.

As another example, the waveguide power divider device 100 may comprise matching sections 16 in the common waveguides 12 of the orthomode junctions 10, see for example FIG. 3A. Alternatively or additionally, the waveguide power divider device 100 may comprise a matching section 48 in the common waveguide 42 of the turnstile junction 40, see for example FIG. 1D and FIG. 3B.

Although not implemented in the embodiments described here, matching sections may also be added in the T-junctions to further improve the overall performance of the power divider. However, it has been found that this is usually not necessary, which contributes to the very compact implementation and small element spacing of the two-port orthomode junctions.

The structure illustrated in FIG. 1A through FIG. 3B is optimized to operate at K-band (17.3-20.2 GHz) for broadband satellite communication down-links. This specific implementation demonstrates that the proposed four-way power divider is compatible with an array spacing as small as 0.7 wavelengths, the wavelength being defined at the lowest operating frequency. However, waveguide power divider devices according to embodiments of the disclosure are not limited to operation in the K-band and are applicable to other wavelengths or wavelength ranges as well. It is understood to be readily apparent to the skilled person that the structural features described above may be independent of the intended wavelength of operation.

An attractive property of waveguide power divider devices according to embodiments of the disclosure is that the common waveguide 42 of the four-way power divider device 100 is a dual-mode waveguide (e.g., having square cross section, as shown in the aforementioned figures). This means that four 2×2 arrays may be combined using the very same four-way power divider device, and so on. Hence, the proposed waveguide power divider device 100 may be used to design small or large arrays by combining appropriate numbers of such waveguide power divider devices. While smaller arrays are of interest for space applications, for example as a building block in active antennas, larger arrays could be of interest for terrestrial applications and in particular user terminals.

Figure 6:
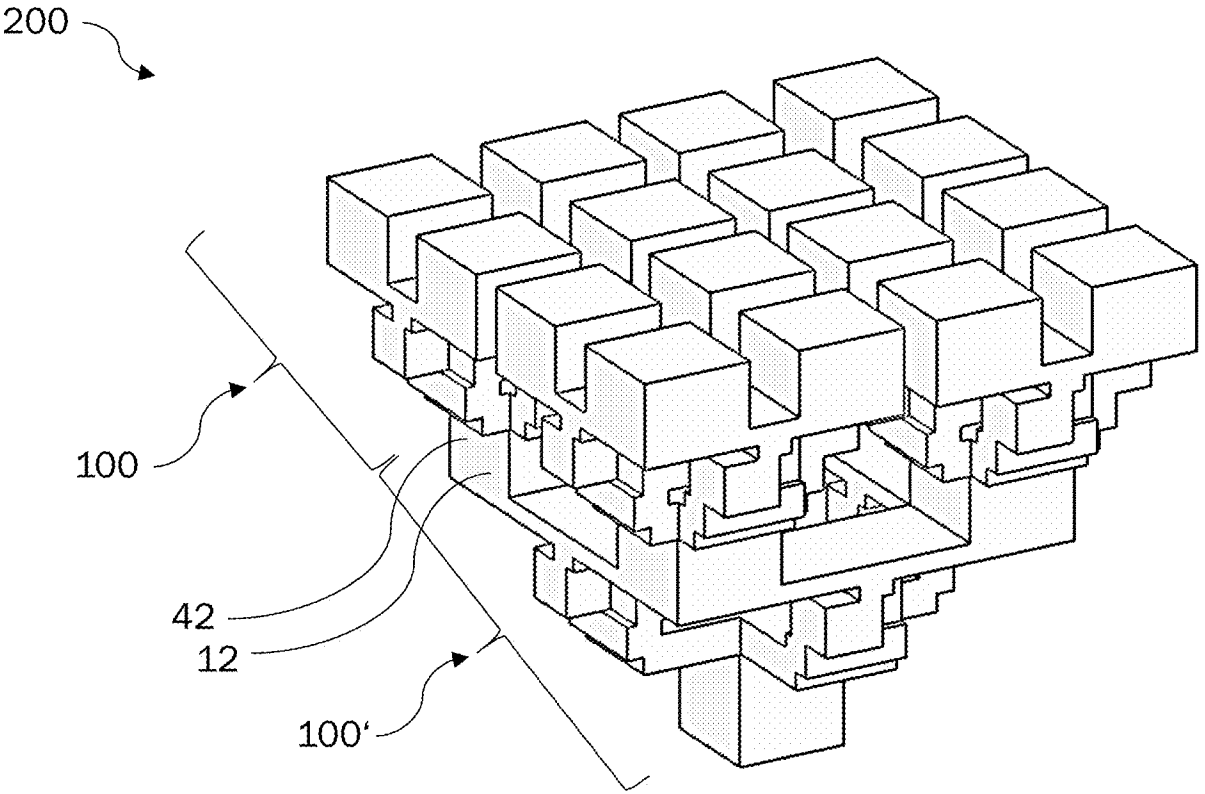

In general, the present disclosure is understood to cover array antennas comprising one or more waveguide power divider devices according to embodiments of the disclosure. In some embodiments, the array antenna may comprise a plurality of waveguide power divider devices according to embodiments of the disclosure. For instance, FIG. 6 schematically illustrates an example of an array antenna 200 comprising five waveguide power divider devices according to embodiments of the disclosure. Four of these waveguide power divider devices 100 are arranged such that the common waveguides 12 of their orthomode junctions 10 form a 4×4 array, and a fifth waveguide power divider device 100' is arranged such that the common waveguides 12 of its orthomode junctions 10 couple to the common waveguides 42 of the turnstile junctions 40 of respective ones among the other four waveguide power divider devices 100.

The array antenna according to the present disclosure comprises a plurality of array elements. These array elements may form the aperture of the array antenna. Due to the specific configuration of the proposed waveguide power divider device, the array elements may be open-ended waveguides corresponding to the common waveguides of the two-port orthomode junctions of one or more of the waveguide power divider devices of the array antenna. That is, the antenna may not comprise any horns. Omission of the horns allows to take full advantage of the very compact spacing between the array antenna elements (i.e., between the common waveguides 12 of the orthomode junctions 10 of the waveguide power divider devices 100). As has been found, even without horns the proposed array antenna has a performance equivalent to that of conventional array antennas with horns.

As mentioned above, the array antenna may comprise a plurality of waveguide power divider devices. At least two of the waveguide power divider devices may be arranged such that the common waveguides of the orthomode junctions of the at least two waveguide power divider devices form an array. For example, the common waveguides of the orthomode junctions may be arranged in a regular (e.g., square or rectangular) lattice. This is the case for the array antenna 200 of FIG. 6, in which four waveguide power divider devices are arranged to form a 4×4 array.

Alternatively or additionally, a first waveguide power divider device among the plurality of waveguide power divider devices may be coupled to a second waveguide power divider device among the plurality of waveguide power divider devices such that the common waveguide 12 of an orthomode junction 10 of the first waveguide power divider device is coupled to the common waveguide 42 of the turnstile junction 40 of the second waveguide power divider device. This is again the case for the array antenna 200 of FIG. 6, in which the common waveguide 12 of an orthomode junction 10 of the waveguide power divider device 100' is coupled to the common waveguide 42 of the turnstile junction 40 of one of the other four waveguide power divider devices 100. In fact, each of the common waveguides 12 of the orthomode junctions 10 of the waveguide power divider device 100' is coupled to a common waveguide 42 of the turnstile junction 40 of a respective one among the other four waveguide power divider devices 100.

In a general example, two or more of the waveguide power divider devices of the array antenna may be arranged to form the aforementioned array (e.g., the 4×4 array in FIG. 6), and at least one further waveguide power divider device may be coupled to the common waveguide of the turnstile junction of one of the waveguide power divider devices through the common waveguide of one of its orthomode junctions (e.g., waveguide power divider devices 100 and 100' in FIG. 6). In particular, the at least one further waveguide power divider device may be coupled to the common waveguides of the turnstile junctions of four of the waveguide power divider devices through the common waveguides of its orthomode junctions.

Next, technical results for waveguide power divider devices according to embodiments of the disclosure will be described. These technical results relate to a specific implementation at K-band used as a four-way power divider (i.e., with one input and four outputs, assuming dual-polarized ports in all square waveguides), but can be readily extended to other implementations. In the example implementation, the radiating elements are open-ended waveguides with a spacing of 12.5 mm ($0.71\lambda_0$ at 17 GHz). The waveguide power divider device was optimized using a finite element method solver, with the goal to keep it as simple as possible.

Figure 7:
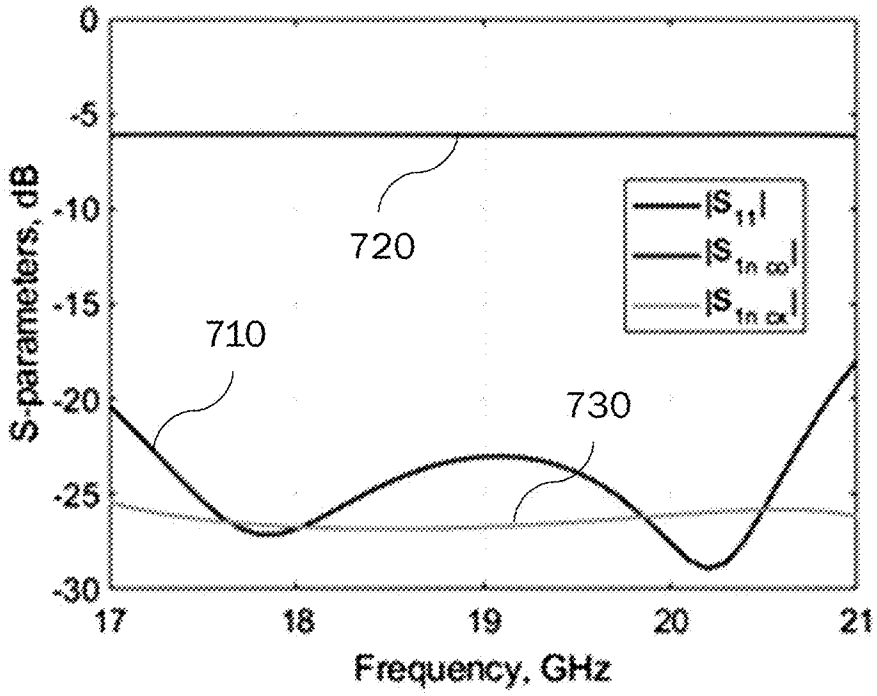
FIG. 7 shows the S-parameters for a waveguide power divider device according to embodiments of the disclosure.

FIG. 7 shows the S-parameters for the waveguide power divider device for a given polarization. The results would be the same for the orthogonal polarization, due to symmetries of the waveguide power divider device. Index 1 for the components of the S-parameter indicates the common port (e.g., input port) of the waveguide power divider device 100, i.e., the common waveguide 42 of the turnstile junction 40. Indices 2 to 5, or alternatively, index n indicate(s) the remaining ports (e.g., output ports) of the waveguide power divider device 100, i.e., the common waveguides 12 of the orthomode junctions 10. Therein, graph 710 illustrates the (1,1) component of the S-parameter, i.e., the reflection coefficient, graph 720 illustrates the (1,n) component of the S-parameter, i.e., the transmission gain, for co-polarization (co), and graph 730 illustrates the (1,n) component of the S-parameter, i.e., the transmission gain, for cross-polarization (cx). As can be seen from these graphs, the waveguide power divider device has a broadband behavior with excellent return loss (reflection coefficient typically <−20 dB) over the analyzed bandwidth, and very flat transmission gain. The cross-polarization transmission gain is found to be very low over the analyzed bandwidth (typically <−25 dB). It could be further suppressed by applying the techniques disclosed in co-pending international patent application No. PCT/EP2019/079563 filed on Oct. 29, 2019, which is herewith incorporated by reference in its entirety, to the four two-port orthomode junctions of the waveguide power divider device.

The symmetrical behavior of the structure for the two orthogonal polarization modes in the absence of manufacturing uncertainties is confirmed by the simulation. For these reason, the results for transmission gain are reported in a generic way (1,n) as all four curves (for n from 2 to 5) are superimposed in simulation, both in co-polarization and cross-polarization.

Figure 8B:
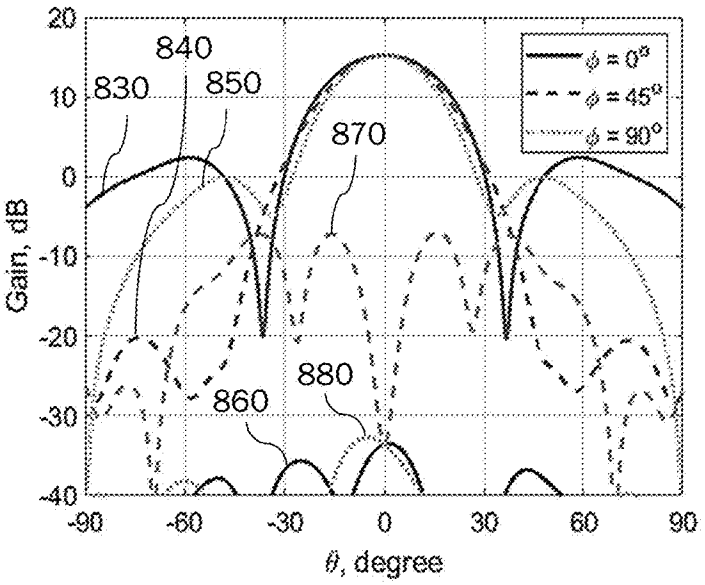
FIG. 8A and FIG. 8B illustrate the performance of a waveguide power divider device according to embodiments of the disclosure when used as a 2×2 array antenna.
Figure 8A:
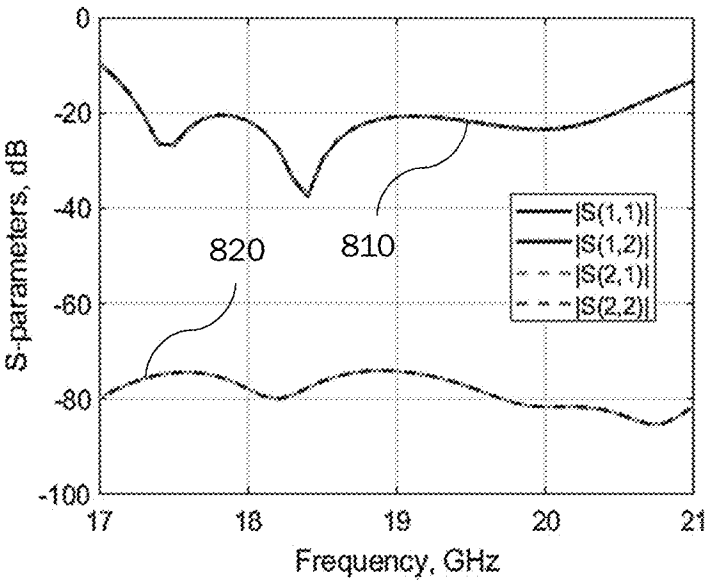

FIG. 8A and FIG. 8B illustrate the performance of the waveguide power divider device when used as a 2×2 array antenna. Beam forming networks of array antennas is one of the main target applications of waveguide power divider devices according to embodiments of the disclosure. Since open-ended waveguides are known to provide poor return loss, it was not obvious that the proposed waveguide power divider device would still operate well when combined with open-ended waveguides to produce an array with very small element spacing.

Specifically, FIG. 8A shows the S-parameters for a waveguide power divider device preliminarily optimized as an array antenna, and FIG. 8B shows radiated gains for this waveguide power divider device as a function of polar angle θ relative to the broadside direction of the aperture (direction orthogonal to the array plane). Graph 810 in FIG. 8A illustrates the (1,1) and (2,2) components of the S-parameter, i.e., the reflection coefficient, while graph 820 illustrates the (2,1) and (1,2) components of the S-parameters, i.e., the isolation between orthogonal modes at the common port. In FIG. 8B, graph 830 illustrates the co-polarization radiation gain of the waveguide power divider device for an azimuthal angle φ=0° (degrees) in the aperture plane, graph 840 illustrates the co-polarization radiation gain for azimuthal angle φ=45°, and graph 850 illustrates the co-polarization radiation gain for azimuthal angle φ=90°. Further, graph 860 illustrates the cross-polarization radiation gain for azimuthal angle φ=0°, graph 870 illustrates the cross-polarization radiation gain for azimuthal angle φ=45°, and graph 880 illustrates the cross-polarization radiation gain for azimuthal angle φ=90°. Here, azimuthal angle φ=0° indicates an axis orthogonal to walls of the common waveguides of the waveguide power divider device.

As can be seen from the graphs of FIG. 8A, the broadband response of the waveguide power divider device is maintained without any additional matching device, such as stubs or irises, indicating the robustness of the proposed design with its potential for further improvement or for further design simplification to comply with manufacturing constraints. In particular, it is interesting to note the excellent isolation between orthogonal polarizations by design, which is expected to provide robust performance in the presence of manufacturing uncertainties. The gain patterns reported in FIG. 8B correspond to the excitation along the x-axis. This results in a pattern with a field aligned along the y-axis. Although the radiating elements operate in their fundamental mode (TE10 or TE01) which have no rotational symmetry, the patterns obtained at array level present a good level of rotation symmetry for what concerns the co-polarization. In other words, despite the square cross section of the waveguides of the waveguide power divider device, the co-polarization radiation gains show high symmetry with respect to the azimuthal angle φ. As expected, the worst-case cross-polarization performance appears in the intermediate plane φ=45°, but the levels are in line with alternative designs. Any asymmetry in θ with respect to θ=0 is due to numerical uncertainties in the simulation as the structure has two axes of symmetry, x and y axes. Anyway, those small asymmetries are found at levels much lower than the peak gain and have no impact on the overall performance of the array antenna.

As noted above, waveguide power divider devices according to embodiments of the disclosure can be combined to form array antennas. A specific implementation extends the proposed design to a 4×4 array.

Figure 9:
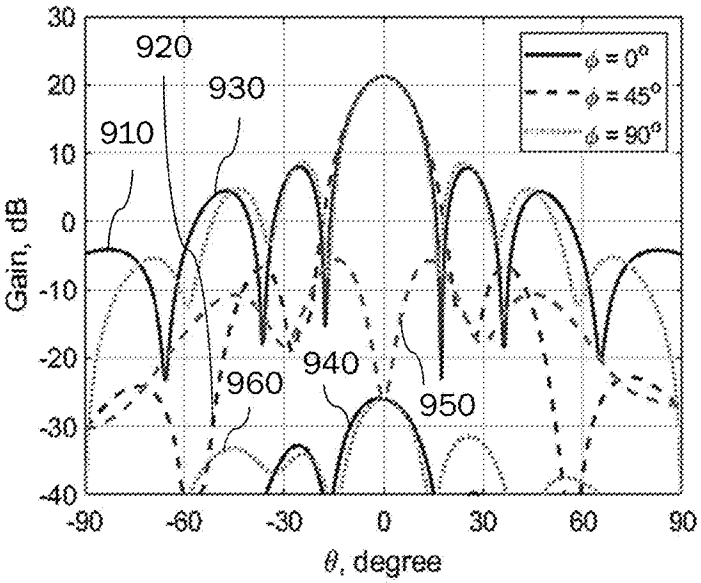
FIG. 9 shows radiated gains for a 4×4 array antenna comprising waveguide power divider devices according to embodiments of the disclosure.

FIG. 9 shows radiated gains for such 4×4 array antenna. Graph 910 illustrates the co-polarization radiation gain of the waveguide power divider device for an azimuthal angle φ=0° (degrees) in the aperture plane, graph 920 illustrates the co-polarization radiation gain for azimuthal angle φ=45°, and graph 930 illustrates the co-polarization radiation gain for azimuthal angle φ=90°. Further, graph 940 illustrates the cross-polarization radiation gain for azimuthal angle φ=0°, graph 950 illustrates the cross-polarization radiation gain for azimuthal angle φ=45°, and graph 960 illustrates the cross-polarization radiation gain for azimuthal angle φ=90°.

The results of FIG. 9 confirm the scalability of a beam forming network based on the proposed waveguide power divider device. The simulated gain for the 4×4 array is about 6 dB larger than that of the 2×2 array, as expected, confirming the good operation of the proposed waveguide power divider device when combined in more complex antenna systems. Again, any asymmetry in θ with respect to θ=0 is due to numerical uncertainties in the simulation and are also found here at levels much lower than the peak gain.

While the figures discussed above show waveguide components with rectangular cross section, the present disclosure is likewise applicable to alternative shapes of the cross sections, such as circular shape, for example.

It should also be noted that the apparatus features described above may correspond to respective method features (e.g., manufacturing method features) that may not be explicitly described, for reasons of conciseness, and vice versa. The disclosure of the present document is considered to extend also to such methods and vice versa.

Thus, while a waveguide power divider device in accordance with embodiments of the disclosure has been described above, the present disclosure likewise relates to a method of manufacturing such waveguide power divider device. This method may comprise steps of providing the components of the waveguide power divider device described above, and optionally, steps of coupling or linking these components. The method may be implemented by additive manufacturing, such as layer-wise additive manufacturing. As such, waveguide power divider devices according to embodiments of the disclosure may be suitable for manufacturing by additive layer manufacturing, such as layer-wise additive manufacturing, for example.

It should further be noted that the description and drawings merely illustrate the principles of the proposed method and system. Those skilled in the art will be able to implement various arrangements that, although not explicitly described or shown herein, embody the principles of the disclosure and are included within its spirit and scope. Furthermore, all examples and embodiment outlined in the present document are principally intended expressly to be only for explanatory purposes to help the reader in understanding the principles of the proposed method and system. Furthermore, all statements herein providing principles, aspects, and embodiments of the disclosure, as well as specific examples thereof, are intended to encompass equivalents thereof.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A waveguide power divider device, comprising:

four two-port orthomode junctions arranged with their common waveguides extending in parallel, wherein the two ports of each orthomode junction extend in orthogonal directions;

four E-plane T-junctions, wherein each T-junction couples two of the four orthomode junctions to each other via respective ones of the ports of the two orthomode junctions;

a four-port turnstile junction, wherein waveguides of the four ports are bent to extend in parallel to an extension direction of a common waveguide of the turnstile junction; and four waveguide twists, wherein each waveguide twist couples a common waveguide of a respective one of the T-junctions to the waveguide of a respective one of the ports of the turnstile junction, with broad walls of the common waveguide of the T-junction and of the waveguide of the port of the turnstile junction being orthogonal to each other, wherein the waveguide twists are arranged to interlock with each other.

2. The waveguide power divider device according to claim 1, wherein the waveguide twists have identical shape and are rotated from one to another by 90 degrees around an axis extending in parallel to the common waveguide of the turnstile junction.

3. The waveguide power divider device according to claim 1, wherein a shape of each waveguide twist when seen from a direction along the common waveguide of the turnstile junction comprises two rectangles that have parallel edges and that overlap with each other at a pair of their corners.

4. The waveguide power divider device according to claim 1, wherein the waveguide twists are offset twists.

5. The waveguide power divider device according to claim 1, wherein:

for each orthomode junction, the two ports each face one of the ports of a respective other orthomode junction among the orthomode junctions; and each T-junction couples facing ports of respective orthomode junctions to each other.

6. The waveguide power divider device according claim 1, wherein the turnstile junction comprises one or more steps in the bends of each of its four ports.

7. The waveguide power divider device according claim 1, further comprising matching sections in the common waveguides of the orthomode junctions and/or a matching section in the common waveguide of the turnstile junction.

8. The waveguide power divider device according claim 1, wherein the waveguide power divider device is a dual-polarization power divider device.

9. The waveguide power divider device according claim 1, wherein the waveguide power divider device is suitable for manufacturing by additive layer manufacturing.

10. An array antenna comprising one or more waveguide power divider devices according to claim 1.

11. The array antenna according to claim 10, wherein:

the array antenna comprises a plurality of array elements; and the array elements are open-ended waveguides corresponding to the common waveguides of the two-port orthomode junctions of one or more of the one or more waveguide power divider devices.

12. The array antenna according to claim 10, wherein:

the array antenna comprises a plurality of waveguide power divider devices; and at least two of the waveguide power divider devices are arranged such that the common waveguides of the orthomode junctions of the at least two waveguide power divider devices form an array.

13. The array antenna according to claim 10, wherein:

the array antenna comprises a plurality of waveguide power divider devices; and a first waveguide power divider device among the plurality of waveguide power divider devices is coupled to a second waveguide power divider device among the plurality of waveguide power divider devices, wherein the common waveguide of an orthomode junction of the first waveguide power divider device is coupled to the common waveguide of the turnstile junction of the second waveguide power divider device.

* * * * *